US009518410B2

(12) United States Patent
Vasi et al.

(10) Patent No.: US 9,518,410 B2
(45) Date of Patent: Dec. 13, 2016

(54) FLUSH MOUNTED VEHICLE HANDLE

(71) Applicant: AISIN TECHNICAL CENTER OF AMERICA, INC., Plymouth, MI (US)

(72) Inventors: Stephanie Vasi, Royal Oak, MI (US); Eric Archambeau, Canton, MI (US); Mike Howlett, Troy, MI (US); Patrick Stewart, Taylor, MI (US)

(73) Assignee: AISIN TECHNICAL CENTER OF AMERICA, INC., Plymouth, MI (US)

( * ) Notice: Subject to any disclaimer, the term of this patent is extended or adjusted under 35 U.S.C. 154(b) by 125 days.

(21) Appl. No.: 14/267,490

(22) Filed: May 1, 2014

(65) Prior Publication Data

US 2015/0315812 A1 Nov. 5, 2015

(51) Int. Cl.

| | |
|---|---|
| ***E05B 3/00*** | (2006.01) |
| ***E05B 85/10*** | (2014.01) |
| ***E05B 5/00*** | (2006.01) |
| ***E05B 81/08*** | (2014.01) |
| *E05B 81/14* | (2014.01) |

(52) U.S. Cl.

CPC ..... *E05B 85/103* (2013.01); *E05B 5/006* (2013.01); *E05B 81/08* (2013.01); *E05B 81/14* (2013.01); *Y10T 292/57* (2015.04)

(58) Field of Classification Search

CPC ..... F16J 15/188; E05B 5/006

See application file for complete search history.

(56) References Cited

U.S. PATENT DOCUMENTS

| | | | | |
|---|---|---|---|---|
| 4,588,219 | A | 5/1986 | Kobayashi et al. | |
| 5,560,659 | A * | 10/1996 | Dault | 292/336.3 |
| 6,490,896 | B2 * | 12/2002 | Segawa | 70/208 |
| 7,108,301 | B2 * | 9/2006 | Louvel | E05B 81/78 292/201 |
| 8,943,752 | B2 * | 2/2015 | Thomas et al. | 49/394 |
| 2012/0174633 | A1 * | 7/2012 | Bacon | 70/77 |

OTHER PUBLICATIONS

U.S. Appl. No. 14/182,763, filed Feb. 18, 2014, Vasi, et al.

* cited by examiner

*Primary Examiner* — Kristina Fulton
*Assistant Examiner* — Thomas Neubauer
(74) *Attorney, Agent, or Firm* — Oblon, McClelland, Maier & Neustadt, L.L.P.

(57) ABSTRACT

An outside handle of a door of a vehicle that opens a latch, including a rotatable flap that sits flush against an outer panel of the vehicle in a closed position and that provides an opening to an interior of the handle in an open position, and a rotating lever behind the outer panel, movement of the lever opening the latch of the door. The handle is arranged such that the flap rotates to the open position when the door is unlocked and rotates to the closed position when the door is locked.

9 Claims, 4 Drawing Sheets

FLUSH MOUNTED VEHICLE HANDLE

BACKGROUND OF THE INVENTION

Field of the Invention

Exemplary aspects of the present invention relate to a hidden, flush mounted outside handle for opening a door of a vehicle.

SUMMARY OF THE INVENTION

The present application relates to a door handle of a vehicle with a flush and aerodynamic appearance by placing the mechanical pieces behind an outer panel and keeping them hidden. The functionality of the handle is not compromised, and a user is able to grip the handle in a similar motion to the current outside handle design.

The outside handle of includes a rotatable flap that sits flush against an outer panel of the vehicle in a closed position. When the vehicle is unlocked from a key fob, smart key system, or the like, the rotatable flap rotates backward to reveal an opening into which a hand may be placed in order to operate the handle.

The handle includes a rotating lever behind the outer panel, and a lock rod attached to the rotating lever. Downward rotation of the lever moves the rod downward, and the downward motion of the rod then triggers the latch allowing the door to be opened.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION OF THE PREFERRED EMBODIMENTS

Figure 1:
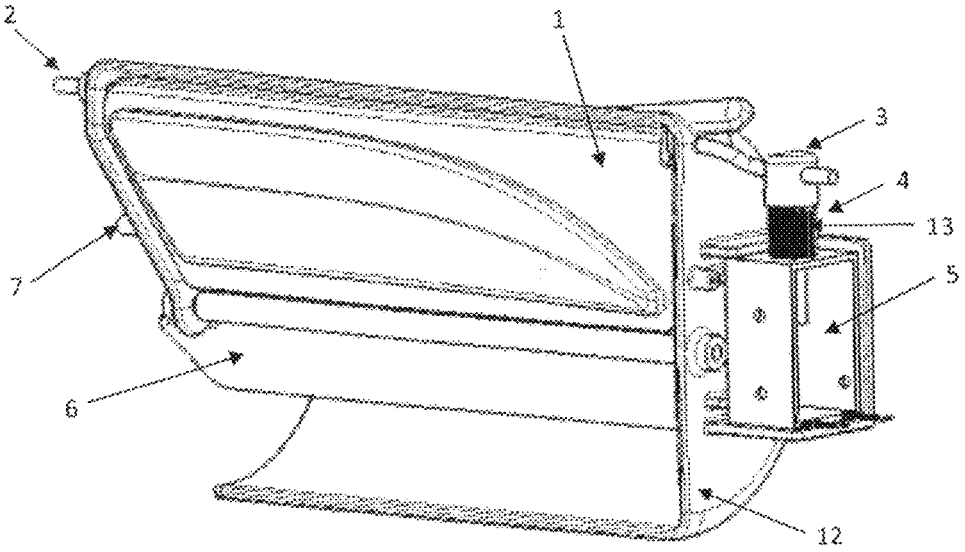
FIG. 1 illustrates an isometric view of a hidden handle assembly in the closed position in accordance with the present disclosure.

Referring now to the drawings, wherein like reference numerals designate identical or corresponding parts throughout the several views. Further, as used herein, the words "a," "an" and the like generally carry a meaning of "one or more," unless stated otherwise.

FIGS. 1-8 depict various aspects of a hidden door handle for a vehicle. Here a vehicle refers to a land vehicle exemplified by an automobile. However, the present disclosure is also applicable to any similar type vehicle, such as but not limited to, a sport utility vehicle, a pickup truck, a commercial vehicle, aircraft, boat, or the like.

Figure 3:
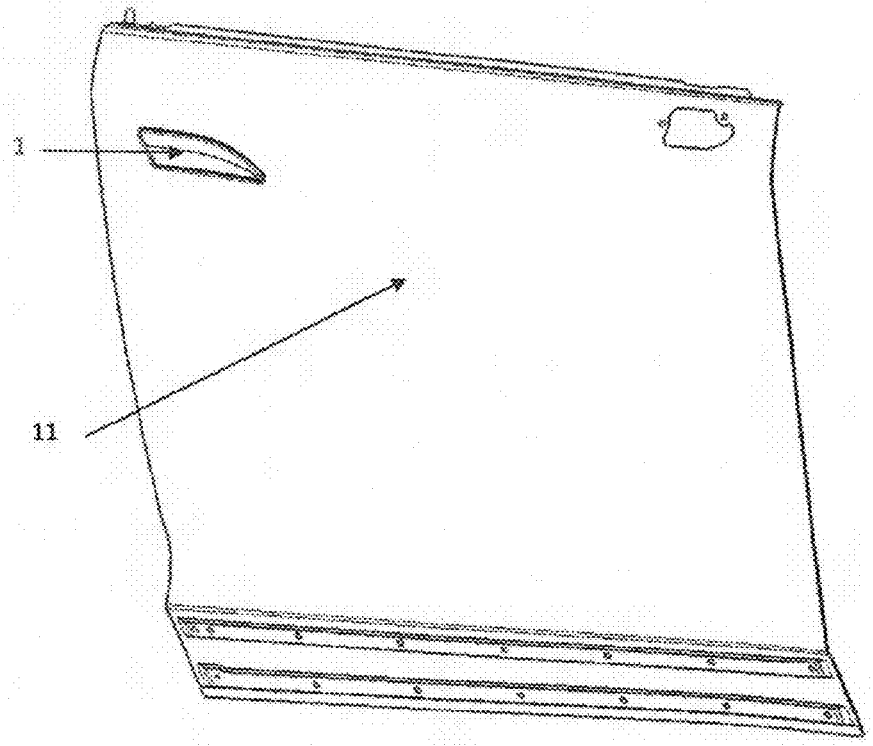
FIG. 3 illustrates an isometric view a hidden handle assembly in the closed position, attached to the door panel from the exterior of the vehicle in accordance with the present disclosure.

FIG. 1 displays an isometric front view of a hidden door handle assembly without a door panel. FIG. 3 illustrates a top flap 1 of the hidden door handle assembly disposed in an outer door panel 11. The flap 1 has a contoured shape, but is not limited to such a shape. The illustrated door panel 11 is a right side door of a vehicle but is not so limited. Here, an outer surface of the top flap 1 sits flush with the outer door panel 11. The top flap 1 is the only part of the handle that is seen from the exterior and fits properly into a slot made in the outer panel 11 of the door. This is what creates the flush appearance to the exterior of the vehicle.

As shown in FIG. 1, the top flap 1 includes a base part that is generally rectangular and a generally elliptical part that protrudes through the door panel 11 to sit flush with the door panel 11. The elliptical part being attached or formed as one piece on top of the rectangular part.

Behind the top flap 1 is an interior space defined partially by the flap and a case 12. Shown in FIGS. 4-8, the case 12 has a back surface opposite to the flap 1 in the closed position. As shown in the figures, the case 12 supports the operational parts of the handle assembly. Aside from aiding in mounting and supporting the components, the case 12 aids the user to feel more comfortable inserting their hand inside the door.

A bent rod 2 is attached to the top flap 1 and forms an axis of rotation for the top flap 1. The bent rod 2 is mounted in a side of the case 12, so that the bent rod 2 is able to rotate relative to the case 12. Rotation of the bent rod 2 causes rotation of the top flap 1 which is mounted on the bent rod 2.

Figure 6:
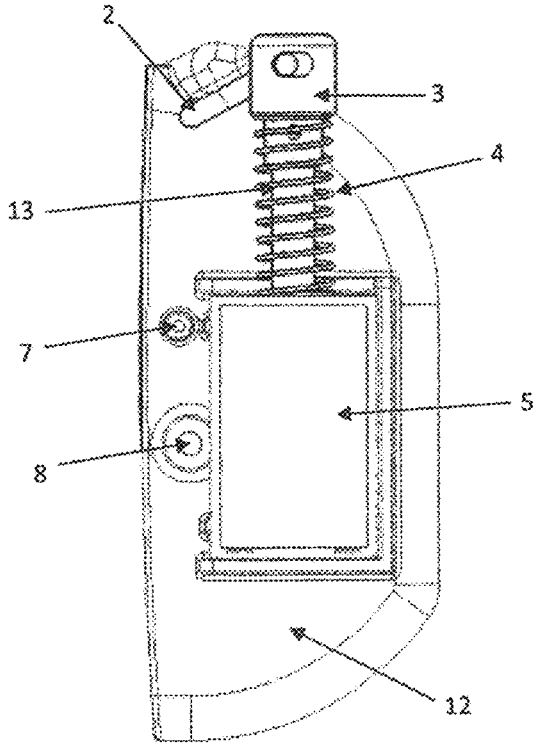
FIG. 6 illustrates a second side view of a hidden handle assembly in the open position in accordance with the present disclosure.

On an opposite side of the case 12 the bent rod protrudes from the case 12 and is the other end is held in a connector 3. Shown in the figures, the connector 3 has a generally cylindrical shape but is not so limited. FIG. 6 illustrates a slot in the connector 3 which receives and end of the rod 2. The bent rod 2 includes a Z or S-shaped bend between the point where the rod 2 exits the case 12 and where it enters the connector 3, as shown for example in FIG. 2.

The connector 3 retains the end of the bent rod 2 so that the bent rod 2 is restrained in a vertical direction of the rod. The connector 3 fits on a top of a solenoid shaft 13 which is provided adjacent and approximately parallel to the side of the case 12. The connector 3 moving integrally with the solenoid shaft 13.

Figure 2:
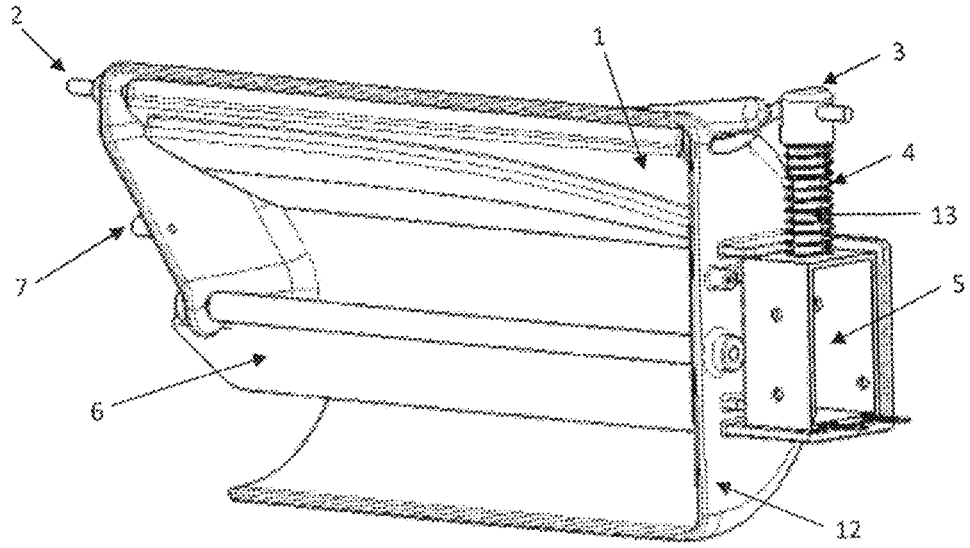
FIG. 2 illustrates an isometric view of a hidden handle assembly in the open position in accordance with the present disclosure.
Figure 5:
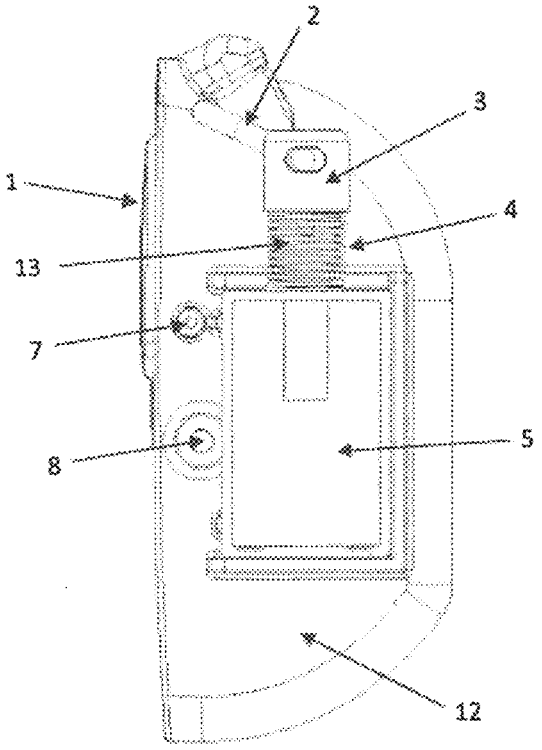
FIG. 5 illustrates a second side view of a hidden handle assembly in a closed position in accordance with the present disclosure.

Shown in FIG. 2, the solenoid shaft 13 is circumferentially surrounded by a compression spring 4 which biases the solenoid shaft 13 upward toward the open position. The compression spring 4 rests between a bottom of the connector 3 and the top of a solenoid 5. The solenoid 5 moves the solenoid shaft 13 in an axial direction. FIG. 5 illustrates the solenoid 5 in the closed position such that the solenoid shaft 13 is pulled down against the bias force of the compression spring 4. FIG. 6 illustrates the solenoid 5 in the open position such that the solenoid shaft 13 is up and the compression spring 4 is extended. Further, the solenoid shaft 13 is stopped in the open position by an overhang on the case 12 as shown in FIG. 6.

The connector 3 moves integrally with the axial movement of the solenoid shaft 13. Therefore, actuation of the solenoid 5 causes the connector 3 to move up and down which causes the bent rod 2 to rotate relative to the case 12 due to the bent shape of the rod 2. That is, the bent shape of the bent rod 2 translates the vertical movement of the solenoid to the rotational movement of the top flap 1. Accordingly, actuation of the solenoid 5 causes the top flap 1 to open and close.

Figure 7:
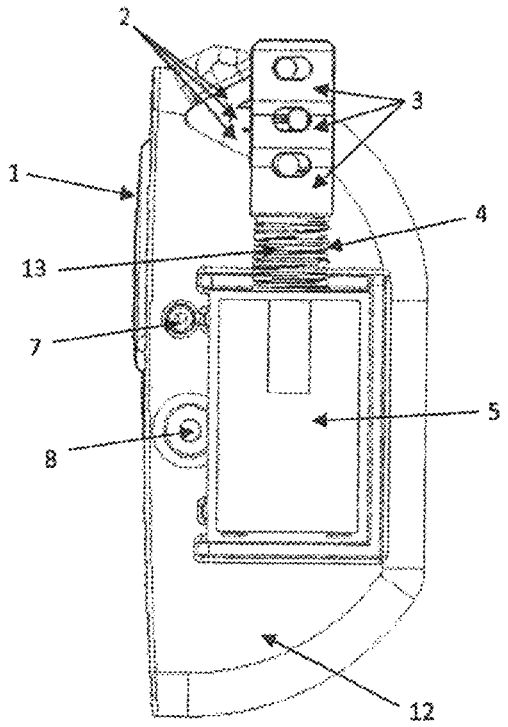
FIG. 7 illustrates a second side view of a hidden handle assembly in various opening states in accordance with the present disclosure.

An operation of the top flap 1 will now be described in detail. The top flap 1 begins in the closed position which is flush with the door panel 11 as shown in FIG. 3. Here, the solenoid 5 is in the closed position shown in FIG. 5. An unlock signal is then transmitted via a key fob, smart key system or the like. Once this unlock signal is received the solenoid 5 is actuated toward the open position. FIG. 7 illustrates the connector 3 and the bent rod 2 during the opening process. Shown in FIG. 3, the upward motion of the solenoid shaft 13 causes the connector 3 to translate in the axial direction. Three positions of the connector 3 are shown in FIG. 7. These three positions also correspond to three positions of the bent rod 2. As shown in FIG. 7, as the connector 3 moves upward, the end of the bent rod 2 is also moved upward which causes the bent rod 2 to rotate relative the case 12.

Figure 8:
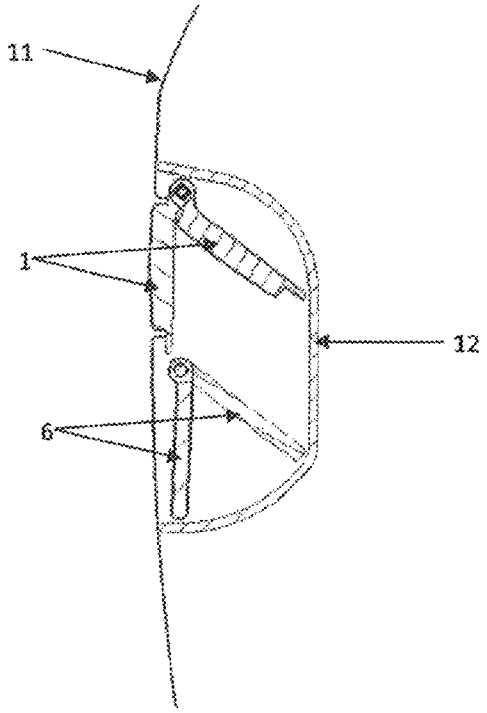
FIG. 8 illustrates a section cut of a hidden handle assembly from top to bottom in an open and in a closed position.

FIG. 8 illustrates the open and closed position of the top flap 1. The open position corresponds to the connector 3 being moved upward and the closed position corresponds to the connector 3 being down.

Described above, when the door is unlocked by a key fob, smart key, or the like, the solenoid 5 is operated so as to operate the top flap 1 into the open position. Thereby, allowing access to the interior space of the hidden door handle assembly formed by the case 12.

A door unlatching operation of the hidden door handle assembly will now be described.

A rod 8 is attached to a lever 6. The rod 8 is located at a middle portion of the side surfaces of the case 12 and extends from one side of the case 12 to the other side of the case 12. The rod 8 is substantially parallel to the portion of the bent rod 2 which traverses the case 12. The rod 8 defines an axis of rotation for the lever 6. That is, the lever 6 rotates relative to the case 12 via the rod 8.

Figure 4:
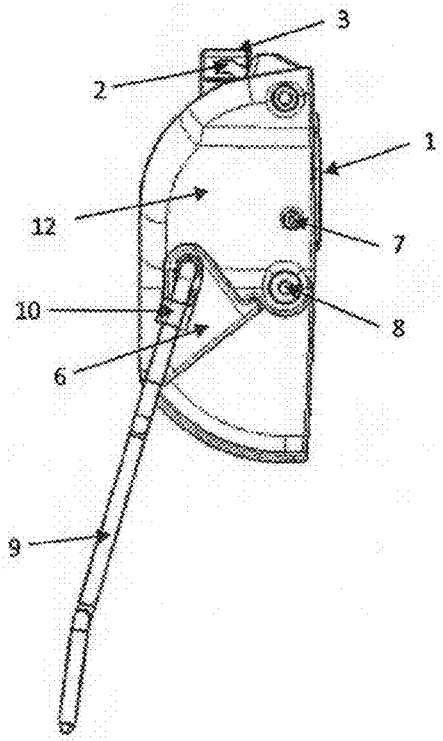
FIG. 4 illustrates a first side view of a hidden handle assembly in the closed position in accordance with the present disclosure.

Shown in FIG. 4, the lever 6 has two portions. A first portion of the lever 6 is generally rectangular and is pivotable around the rod 8. The second portion of the lever 6 is generally triangular and extends from an end of the first portion. The second portion is formed at an angle relative to the first portion. The angle being approximately 90 degrees in the figures. A lock rod 9 is attached to the lever 2 at the second portion. The lock rod 9 is attached to a latching mechanism or latch of the door (not illustrated), and sufficient movement of the lock rod 9 opens the latching mechanism, thereby allowing the door to be opened. The lock rod 9 is attached to the lever 6 by a rod clip 10 and is able to rotate freely.

FIG. 8 illustrates different positions and motions of the top flap 1 and the lever 6 during operation. Two positions of the lever 6 are illustrated in FIG. 8. The first position is rest position located on the right in FIG. 8. The second position (on the left of FIG. 8) is an unlatched position, which is a position caused by the hand/finger(s) of a user. That is, once the top flap 1 allows access to the interior space of case 12, a hand, finger(s) or the like is able to move the lever 6 to the unlatched position. When the lever 6 is moved a sufficient distance (i.e. to the unlatched position), the lock lever 9 is moved a sufficient amount so that the latch is triggered. The second position of the lever 6 in FIG. 8, is a position in which the user has fully clamped the handle and where the lever 6 would touch the outer panel 11 of the door. Described above, when the lever 6 is clamped a sufficient distance, the lock rod 9 is moved by the lever 6 a sufficient distance to release the door latch. Accordingly, the door may be opened.

When the key fob or smart key system locks the door, then the top flap 1 is closed by the solenoid 5. That is, once the door is locked, the solenoid 5 pulls the solenoid shaft 13 downward as shown in FIG. 5. This movement, in turn, moves the connector 3 down which rotates the bent rod 2, therefore rotating the top flap 1 to the closed, flush position.

The hidden door latch assembly is also provided with a sensor to prevent the inadvertent closing of the top flap 1 when a user's hand or another object is still within the case 12. Sensor 7 is provided to the interior of the case 12. The Figures illustrate the sensor 7 provided to both of the side walls of the case 12 but numerous modifications are possible. The sensor 7 is a proximity sensor, a movement sensor, or the like. In one embodiment the sensor 7 is a photoelectric sensor that emits a beam of light, that when broken, activates the solenoid 5 to open. Alternatively, when the beam of light is broken, then the solenoid 5 is prevented from closing even if a lock action is performed by the key fob or smart key system. Accordingly, a user's hand can be prevented from being harmed by the closing of the top flap 1.

Other safety systems can also be used with the hidden handle assembly such as a switch on lever 6 which detects whether the lever 6 is moved from the neutral position. Additionally, a switch can be provided to the top flap 1 which measures if there is an obstruction to closing the top flap 1. That is, if resistance to the closing the top flap 1 is detected (e.g. a hand is in the way) then the solenoid 5 is commanded to open.

Described above, the hidden handle assembly of the present application has several advantages. The first being a sleek and aerodynamic appearance from the outside of the vehicle. Further, the user's hand operates the handle in a similar gripping motion to typical door handles. Therefore, the user gets the benefit of the exterior appearance and customary motion. Moreover, safety is considered by preventing the flap from closing on a user's hand.

Obviously, numerous modifications and variations of the present invention are possible in light of the above teachings. It is therefore to be understood that within the scope of the appended claims, the invention may be practiced otherwise than as specifically described herein.

The invention claimed is:

1. An outside handle of a door of a vehicle that opens a latch, comprising:

a flap that sits flush against an outer panel of the vehicle in a closed position and that provides an opening to an interior of the handle in an open position;

a rotating lever behind the outer panel, movement of the lever opening the latch of the door;

a case that encloses the lever and that defines the interior of the handle, the flap rotating relative to the case;

a solenoid on an outer surface of the case that rotates the flap to the open position when the door is unlocked and that rotates to the closed position when the door is locked, the solenoid including a solenoid shaft; and a bent rod including a first portion around which the flap rotates, a second portion which connects to an end of the solenoid shaft, and a third portion that connects the first and second portions.

2. The outside handle of claim 1, wherein:

the bent rod translates a vertical movement of the solenoid to a rotational movement of the flap.

3. The outside handle of claim 1, further comprising:

a sensor provided to an interior the case that detects an object inside the case, wherein the solenoid rotates the flap to the open position when the sensor detects the object.

4. The outside handle of claim 1, wherein a complete range of rotation of the lever is within in a space defined by the case and outer panel.

5. The outside handle of claim 3, wherein the sensor is on facing interior walls of the case.

6. The outside handle of claim 5, wherein the sensor is a photoelectric sensor.

7. The outside handle of claim 1, wherein the first portion and the second portion are substantially parallel and the third portion is substantially perpendicular to both the first and second portions.

8. The outside handle of claim 7, wherein the first portion is inside the case and the second and third portions are outside the case.

9. The outside handle of claim 1, wherein the solenoid shaft is circumferentially surrounded by a compression spring which biases the solenoid shaft upward toward the open position of the flap.

* * * * *